US010081379B2

(12) United States Patent
Kull

(10) Patent No.: US 10,081,379 B2
(45) Date of Patent: Sep. 25, 2018

(54) BROKEN RAIL DETECTION SYSTEM FOR COMMUNICATIONS-BASED TRAIN CONTROL

(71) Applicant: Wabtec Holding Corp., Wilmerding, PA (US)

(72) Inventor: Robert C. Kull, Olney, MD (US)

(73) Assignee: Wabtec Holding Corp., Wilmerding, PA (US)

( * ) Notice: Subject to any disclaimer, the term of this patent is extended or adjusted under 35 U.S.C. 154(b) by 0 days.

(21) Appl. No.: 15/894,346

(22) Filed: Feb. 12, 2018

(65) Prior Publication Data

US 2018/0162429 A1 Jun. 14, 2018

Related U.S. Application Data

(63) Continuation of application No. 14/893,714, filed as application No. PCT/US2014/036880 on May 6, 2014, now Pat. No. 9,889,869.

(60) Provisional application No. 61/828,902, filed on May 30, 2013.

(51) Int. Cl.

| | |
|---|---|
| ***B61L 27/00*** | (2006.01) |
| ***B61L 23/04*** | (2006.01) |
| ***B61L 25/02*** | (2006.01) |

(52) U.S. Cl.

CPC ..... *B61L 27/0088* (2013.01); *B61L 23/044* (2013.01); *B61L 25/02* (2013.01)

(58) Field of Classification Search

CPC ..... B61L 23/04; B61L 23/042; B61L 23/044; B61L 23/047; B61L 23/048; B61L 1/18; B61L 1/188

See application file for complete search history.

(56) References Cited

U.S. PATENT DOCUMENTS

| | | | | |
|---|---|---|---|---|
| 4,306,694 | A | 12/1981 | Kuhn | |
| 4,728,063 | A | 3/1988 | Petit et al. | |
| 4,886,226 | A * | 12/1989 | Frielinghaus | B61L 23/041 246/121 |

(Continued)

FOREIGN PATENT DOCUMENTS

| | | | |
|---|---|---|---|
| WO | 2014027977 | A1 | 2/2014 |
| WO | 2014026086 | A3 | 5/2014 |
| WO | 2014163864 | A1 | 10/2014 |

OTHER PUBLICATIONS

Sullivan; "CBTC Radios—What to do? Which Way to Go?"; Draft Version of Article published in Railway Age's 2005 C&S Buyer's Guide.

(Continued)

*Primary Examiner* — Jason C Smith
(74) *Attorney, Agent, or Firm* — The Webb Law Firm

(57) ABSTRACT

A system and method for detecting broken rails in a track of parallel rails includes at least one first broken rail detection module configured to measure a current through the track and a central control system configured to determine a location of at least one train on the track. The at least one first broken rail detection module is configured to send the central control system a signal based on the measured current. The central control office is configured to determine if a broken rail exists on the track and/or a location of the broken rail on the track based at least partially on the measured current and the location of the at least one train on the track.

20 Claims, 4 Drawing Sheets

(56) References Cited

U.S. PATENT DOCUMENTS 4,979,392 A * 12/1990 Guinon ..... B61L 23/044 246/121
5,145,131 A 9/1992 Franke
5,263,670 A * 11/1993 Colbaugh ..... B61L 3/246 246/167 R
5,398,894 A * 3/1995 Pascoe ..... B61L 21/10 246/122 R
5,470,034 A 11/1995 Reeves
5,533,695 A * 7/1996 Heggestad ..... B61L 27/0038 246/1 R
5,680,054 A * 10/1997 Gauthier ..... B61L 23/044 246/121
5,804,731 A 9/1998 Jaeggi
5,978,718 A 11/1999 Kull
5,995,881 A 11/1999 Kull
6,102,340 A * 8/2000 Peek ..... B61L 23/044 246/121
6,119,353 A * 9/2000 Grønskov ..... E01B 35/12 33/1 Q
6,262,573 B1 * 7/2001 Wojnarowski ..... B61K 9/10 324/217
6,424,150 B2 * 7/2002 Kwun ..... 324/216
6,549,005 B1 * 4/2003 Hay ..... G01N 27/82 324/217
6,779,761 B2 * 8/2004 Holgate ..... B61L 23/044 246/122 R
6,845,953 B2 * 1/2005 Kane ..... B61L 3/125 246/167 R
6,848,658 B2 2/2005 McAllister
6,863,246 B2 * 3/2005 Kane ..... B61L 1/20 246/121
6,895,362 B2 * 5/2005 Davenport ..... B61L 23/041 246/120
6,951,132 B2 10/2005 Davenport et al.
6,957,131 B2 * 10/2005 Kane ..... B61L 3/12 701/19
6,996,461 B2 * 2/2006 Kane ..... B61L 3/004 116/36
7,017,864 B2 * 3/2006 McAllister ..... B61L 1/188 246/34 R
7,036,774 B2 5/2006 Kane et al.
7,219,067 B1 * 5/2007 McMullen ..... B61L 27/0011 246/122 R
7,226,021 B1 * 6/2007 Anderson ..... B61L 23/044 246/120
7,268,565 B2 * 9/2007 Anderson ..... B61L 23/044 246/121
7,403,296 B2 * 7/2008 Farritor ..... G01N 3/48 356/614
7,467,032 B2 * 12/2008 Kane ..... B61L 15/0027 104/307
7,616,329 B2 * 11/2009 Villar ..... B61K 9/08 356/625
7,755,660 B2 * 7/2010 Nejikovsky ..... B61K 9/08 348/135
7,755,774 B2 7/2010 Farritor et al.
7,823,841 B2 * 11/2010 Anderson ..... B61L 23/044 246/121
7,920,984 B2 * 4/2011 Farritor ..... B61K 9/08 356/614
7,937,246 B2 * 5/2011 Farritor ..... B61K 9/08 356/614
7,954,770 B2 * 6/2011 Tomlinson, Jr. ..... B61L 23/044 246/121
7,999,848 B2 * 8/2011 Chew ..... B61K 9/08 348/143
8,332,147 B2 * 12/2012 Robinson ..... E01B 35/12 701/470
8,577,647 B2 11/2013 Farritor et al.
8,905,359 B2 12/2014 Li et al.
8,914,162 B2 12/2014 Kemwein et al.
2001/0019263 A1 9/2001 Kwun et al.
2002/0113170 A1 * 8/2002 Grappone ..... B61L 23/044 246/120
2003/0112131 A1 6/2003 McAllister
2005/0061923 A1 3/2005 Kane et al.
2005/0076716 A1 * 4/2005 Turner ..... B61L 23/041 73/579
2006/0017911 A1 1/2006 Villar et al.
2008/0105791 A1 * 5/2008 Karg ..... B61K 9/10 246/120
2010/0204857 A1 * 8/2010 Forrest ..... B61L 27/0094 701/19
2012/0300060 A1 * 11/2012 Farritor ..... B61K 9/08 348/125
2013/0284859 A1 * 10/2013 Polivka ..... B61L 27/0055 246/34 R
2014/0041980 A1 2/2014 Noffsinger et al.
2014/0125356 A1 5/2014 Cooper et al.
2014/0129154 A1 * 5/2014 Cooper ..... B61L 3/121 702/34
2014/0138493 A1 * 5/2014 Noffsinger ..... B61L 3/10 246/121
2014/0152814 A1 * 6/2014 Farritor ..... B61K 9/08 348/142
2014/0180609 A1 * 6/2014 Berggren ..... G01C 7/04 702/42
2014/0207317 A1 * 7/2014 Noffsinger ..... B61K 9/10 701/19
2014/0238139 A1 8/2014 Loveday
2015/0051792 A1 2/2015 Kristen et al.
2015/0291192 A1 10/2015 Li et al.
2016/0075356 A1 * 3/2016 Kull ..... B61L 23/044 246/121
2016/0107664 A1 * 4/2016 Kull ..... B61L 23/044 246/121

OTHER PUBLICATIONS

Turner; "Feasibility of Locomotive-Mounted Broken Rail Detection—Final Report for High-Speed Rail IDEA Project 38"; IDEA Innovations Deserving Exploratory Analysis Programs; Transportation Research Board of the National Academies; Jun. 2004.

* cited by examiner

BROKEN RAIL DETECTION SYSTEM FOR COMMUNICATIONS-BASED TRAIN CONTROL

CROSS REFERENCE TO RELATED APPLICATIONS

This application claims the benefit of U.S. Provisional Application No. 61/828,902, filed May 30, 2013, the disclosure of which is hereby incorporated in its entirety by reference.

BACKGROUND OF THE INVENTION

Field of the Invention

Preferred and non-limiting embodiments are related to a broken rail detection system and method, and more particularly, to a broken rail detection system and method that utilize information from Communications Based Train Control (CBTC) systems on locations of trains in a train network to detect broken rails.

Description of Related Art

Conventional train signal systems use track circuits for two basic functions: train detection and broken rail detection. In addition, conventional AC coded track circuits are used for track-to-train communications of signal aspect data. The most common type of track circuit used in non-electrified lines is the DC track circuit, which was invented in 1872 and is still widely used today. There are many variations to DC track circuits, including coding to extend lengths and transfer signal information between trackside locations via rails. These variations to DC track circuits use insulated joints to isolate adjacent track circuits. The track circuits are applied to define signal block sections, which are related to signal locations and fixed block train control systems. The signal block sections are used to maintain a safe separation distance between trains.

Audio frequency (AF) track circuits are commonly used in metro signal applications, where shorter headways are required to support trains with shorter stopping distances. AF track circuits are also applied to electrified lines where DC track circuits do not work. AF track circuits do not require insulated joints, but are limited in length due to rail inductance. More specifically, rail inductance typically limits lengths of AF track circuits to about 1 km, as compared to about a 5 km length limit for DC track circuits. Moreover, AF track circuits are more complex and expensive to build and operate than DC track circuits. The combination of increased cost and length limitations render AF track circuits economically impractical for application to lines designed for non-electrified freight traffic.

Heavy haul freight railways predominantly employ continuously welded rail to provide the best rail construction suitable for high axle loads. However, the requirement of insulated joints to use most track circuits, e.g., DC track circuits, for train and broken rail detection results in weak points in the rail, as well as higher maintenance costs. There is thus a clear advantage in minimizing the need for insulated joints, balanced against the economics of alternative solutions.

Communications Based Train Control (CBTC) systems are based upon trains determining and reporting their locations to a control office via radio data communications. A train may also be equipped to monitor its integrity, e.g., to ensure that the train remains connected together as a single unit with a location of each end of the train being known and reported to the control office. CBTC systems may be applied as a moving block configuration, which maintains safe separation distances between trains based upon communications between each of the trains and an office dispatch system. Train separation distances may thus be reduced by the "moving block" configuration based upon train speeds and braking capabilities. When the "moving block" configuration is combined with newer train braking systems, e.g., ECP brakes, braking distances can be further reduced. Safer operation of trains with smaller separation distances therebetween, as well as removal of fixed block and associated wayside signals, can accordingly be supported by CBTC systems.

Conventional CBTC systems can eliminate the need for block track circuits for train detection and associated safe train separation distance functions, but they do not address how to detect broken rail conditions. Conventional track circuits may therefore be applied in addition to the CBTC systems to provide for broken rail protection. In lightly used lines, very long track circuits can be applied, tuned for broken rail detection capabilities, which allow extending lengths to around 8 km. Rail breaks, however, can only be detected by the conventional track circuits when there are no trains in the track circuit section to be tested. If there is a desire to take advantage of CBTC control systems and, operate trains with closer headways, a longer track circuit is often continuously occupied between following trains, leaving no opening to detect rail break conditions in that track circuit. This issue can be addressed by applying shorter DC track circuits, such that there will always be a clear track after a train passes and before the next train occupies the opposite end of each circuit. However, the use of shorter DC track circuits requires adding more wayside equipment locations, which increases costs. Moreover, the use of shorter DC track circuits requires the addition of more insulated joint sections, which also increases costs and lowers reliability.

Conventional track circuits have long been considered as a vital part of train detection. Broken rail detection based on the use of track circuits, however, is only effective when the mechanical rail break also leads to an electrical break in the rail. Rails often fail mechanically, but still maintain a continuous electrical circuit. In some estimates, track circuits successfully detect only about 70% of rail break conditions. This relatively low success rate has led to some railways to abandon use of track circuits for broken rail detection, and to use alternative means for train detection, e.g., axle counters. Heavy haul rail operations with high axle loads, however, typically want to maintain an active means for detecting rail breaks to improve overall rail operations safety. Broken rail detection may thus be considered as part of wayside monitoring systems, similar to dragging equipment and slide fence detectors.

In heavy haul rail operations, almost all rail breaks occur under loaded trains. In most cases, a rail break does not immediately derail the train, but increases risks for the next train to pass that broken section of the rail. It is accordingly advantageous to be able to detect a rail break condition and its approximate location soon after the back end of the train passes the break point.

For conventional rail detection systems using conventional track circuits, if there is a rail break, there is no means to determine the location of the break within the length of the track circuit. The time for railway maintenance to find the break is thus increased.

SUMMARY OF THE INVENTION

Generally, provided is a broken rail detection system for communications-based train control that addresses or overcomes some or all of the deficiencies and drawbacks associated with existing broken rail detection systems. Preferably, provided are a system and method for the detection of broken rails that do not require the use of insulated joints to reduce installation and maintenance costs. Preferably, provided are a system and method for the detection of broken rails that detect rail break conditions immediately after a train passes the rail break location. Preferably, provided are a system and method for the detection of broken rails that determine locations of rail breaks immediately after the rail breaks occur. Preferably, provided are a system and method for the detection of broken rails that employ relatively simple detection hardware having a low cost.

According to a preferred and non-limiting embodiment, a system for detecting broken rails in a track of parallel rails may include at least one first broken rail detection module configured to measure a current through the track and a central control system configured to determine a location of at least one train on the track. The at least one first broken rail detection module is configured to send the central control system a signal based on the measured current, and the central control system is configured to determine if a broken rail exists on the track based at least partially on the measured current and the location of the at least one train on the track.

According to another preferred and non-limiting embodiment, the central control system is configured to determine a location of the broken rail on the track based at least partially on a measurement time of the measured current and a location of the at least one train on the track at the measurement time.

According to still another preferred and non-limiting embodiment, the central control system is configured to determine locations of at least a first train and a second train on the track. The at least one first broken rail detection module is configured to measure a current through a dynamic track circuit formed in the track between the first train and the second train. The central control system is configured to determine if a broken rail exists in the track based at least partially on the measured current and the location of the first train and the second train.

According to a preferred and non-limiting embodiment, the system may include at least one second broken rail detection module configured to apply a shunt to the track. The at least one first broken rail detection module is configured to measure a current through a dynamic track circuit formed in the track between the at least one train and the shunt applied by the at least one second broken rail detection module.

According to another preferred and non-limiting embodiment, a system for detecting broken rails in a track of parallel rails may include a first broken rail detection module configured to apply a first shunt to the track at a first location, a second broken rail detection module configured to apply a second shunt to the track at a second location, a third broken rail detection module configured to measure a current in a track circuit formed between the first shunt and the second shunt and a central control system configured to determine if a broken rail exists on the track between the first broken rail detection module and the second broken rail detection module based at least partially on the measured current in the track circuit.

According to still another preferred and non-limiting embodiment, a method for detecting broken rails in a track of parallel rails may include measuring, by at least one first broken rail detection module, a current through the track. A central control system determines a location of at least one train on the track, and the at least one first broken rail detection module communicates a signal based on the measured current to the central control system. The central control system determines if a broken rail exists on the track based at least partially on the measured current and the location of the at least one train on the track.

According to a preferred and non-limiting embodiment, a method for detecting broken rails in a track of parallel rails may include applying, by a first broken rail detection module, a first shunt to the track at a first location and applying, by a second broken rail detection module, a second shunt to the track at a second location. A third broken rail detection module measures a current in a track circuit formed between the first shunt and the second shunt. A control determines if a broken rail exists on the track between the first broken rail detection module and the second broken rail detection module based on the measured current in the track circuit.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

BRIEF DESCRIPTION OF THE DRAWINGS

Further features and other objects and advantages will become apparent from the following detailed description made with reference to the drawings in which.

DETAILED DESCRIPTION OF THE PREFERRED EMBODIMENTS

Figure 1:
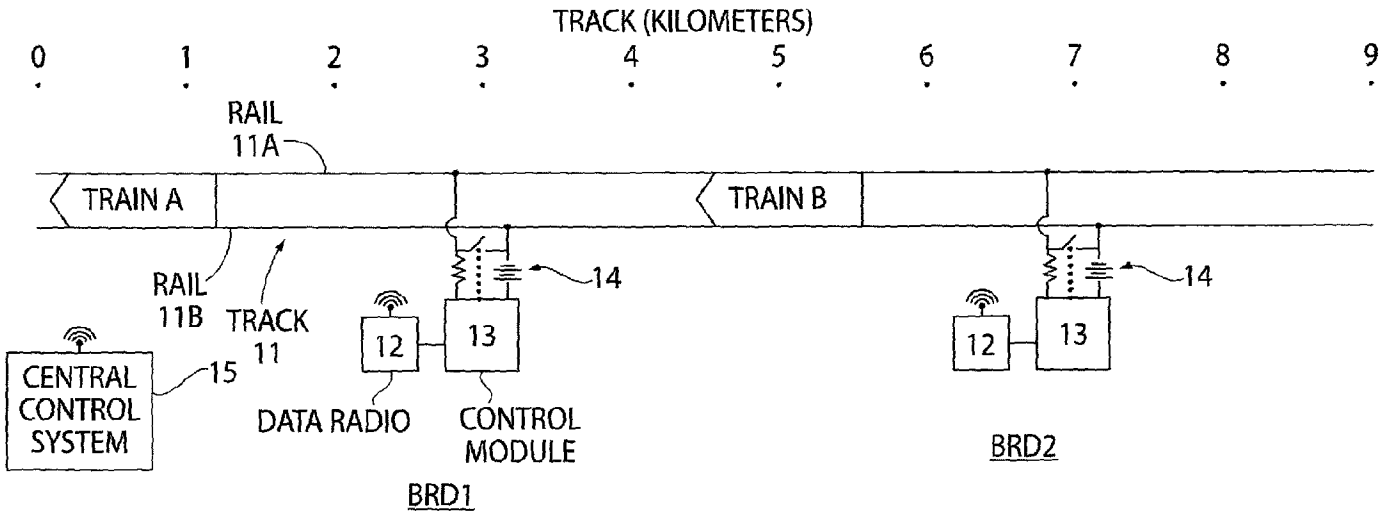
FIG. 1 is a schematic view of one embodiment of a broken rail detection system according to the principles of the present invention.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

As used herein, the terms "communication" and "communicate" refer to the receipt or transfer of one or more signals, messages, commands, or other type of data. For one unit or component to be in communication with another unit or component means that the one unit or component is able to directly or indirectly receive data from and/or transmit data to the other unit or component. This can refer to a direct or indirect connection that may be wired and/or wireless in nature. Additionally, two units or components may be in communication with each other even though the data transmitted may be modified, processed, routed, and the like, between the first and second unit or component. For example, a first unit may be in communication with a second unit even though the first unit passively receives data, and does not actively transmit data to the second unit. As another example, a first unit may be in communication with a second unit if an intermediary unit processes data from one unit and transmits processed data to the second unit. It will be appreciated that numerous other arrangements are possible.

As used herein, the terms "manual control" or "manual controls" refer to one or more controls normally operated by a crew member or other operator. This may include, for example, a throttle and/or dynamic brake handle, an electric air brake actuator and/or controller, a locomotive display, a computer input device, a horn actuator/button, a crossing-signal on/off or selection switch, or any other type of control that is capable of manual operation by a crew member. In a preferred and non-limiting embodiment, the manual control includes a throttle handle used to control the throttle and a dynamic brake arrangement. However, it will be appreciated that any number of manual controls may be used with the manual control interface system.

Preferred and non-limiting embodiments are based upon systems integration with Communications Based Train Control (CBTC) systems, for example, CBTC systems provided by the Wabtec Electronic Train Management System (ETMS). Preferred and non-limiting embodiments utilize CBTC systems' knowledge of locations of a front end and a back end of each train on a line on a substantially real-time basis to interpret data from wayside broken rail detectors.

Preferred and non-limiting embodiments are directed to detecting rail breaks immediately after a last car in a train passes the rail break point since, for heavy haul rail operations with continuously welded rails, rail breaks almost always occur under the train, i.e., at a portion of the rail over which the train is traveling.

Figure 2:
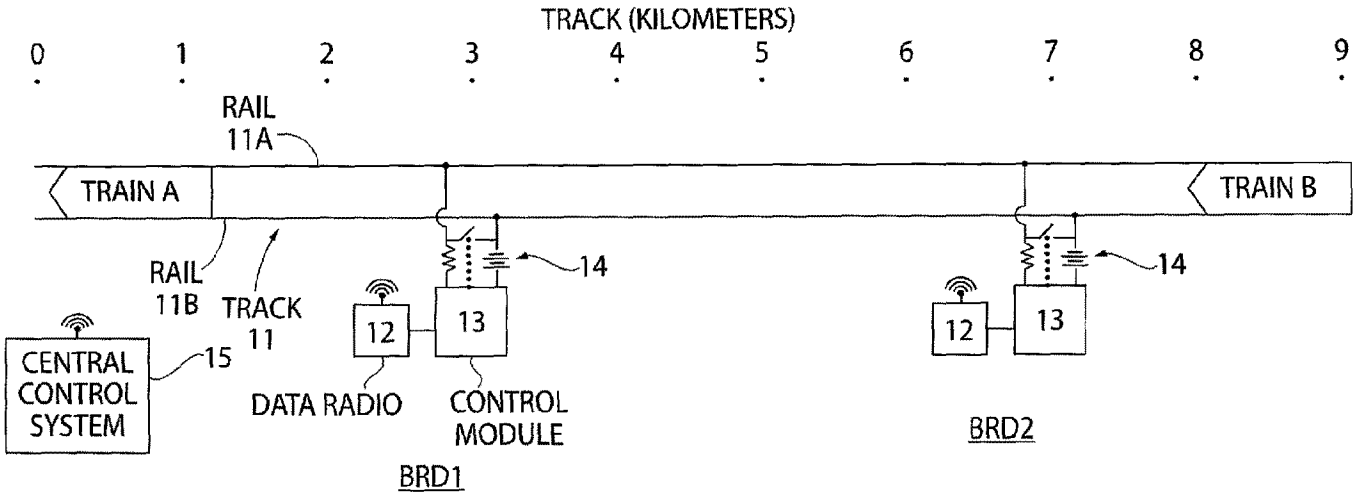
FIG. 2 is a schematic view of another embodiment of a broken rail detection system according to the principles of the present invention.

FIG. 1 illustrates a track with a broken rail detection system according to one preferred and non-limiting embodiment. A track 11 includes two parallel rails 11*a* and 11*b*. The rails 11*a* and 11*b* may be free of insulated joints. For example, the track 11 may include continuously welded rails for heavy haul rail operations. Multiple broken rail detectors (BRDs) are spaced apart from one another at locations along the track 11. Although only a first broken rail detector BRD1 and a second broken rail detector BRD2 are illustrated in FIG. 1, for purposes of clarity, it will be recognized that as the length of the track is extended, additional broken rail detectors can be added. Spacing between the wayside BRDs may be based on a minimum train separation and/or a type of rail. The wayside BRDs may be evenly spaced apart from one another along the track 11. Each broken rail detector BRD includes a radio 12 for data communications to a central control system ("CCS") 15 (e.g., a CBTC control office), and a current measurement/shunt control module 13. Although FIGS. 1 and 2 show a data radio 12 at each broken rail detector BRD location, the data radio 12 may be replaced by landline or other means for communications with the CCS 15 or other central control location. Alternatively, the CCS 15 may be incorporated in one or more of the BRDs.

The broken rail detectors BRDs include hardware that may be relatively simple and small, and operate at low power. The broken rail detectors BRDs also include a microcontroller or computer hardware including a processor and memory configured to control BRD modes (described in more detail below) and communications with the CCS 15. The broken rail detector hardware, in response to control from the CCS 15, is configured to switch "on" and "off" the track voltage applied to the track 11, monitor track circuit current and voltage, with analog to digital conversion and interface to the microcontroller or computer, and to switch "on" and "off" a track shunt (short). The broken rail detectors BRDs may include a track resistor to limit current under shunt conditions. The broken rail detectors BRDs may be housed in a small trackside case, and include a back-up battery and solar and/or wind power generation where power is not readily available.

The CCS 15 includes computer hardware including a processor and one or more types of memory for controlling CBTC systems. For example, the CCS 15 may be a CBTC system provided by the Wabtec ETMS. The CCS 15 may be further configured to process measurements of track circuit current and current measurement times received from the radio 12 of a broken rail detector BRD in combination with its knowledge of locations of trains on the track 11 to determine if a broken rail exists, as well as the location of the broken rail on the track 11.

The current measurement/shunt control module 13 includes a control circuit, e.g., the microcontroller or a computer hardware including a processor and memory, and a shunt circuit 14. The current measurement/shunt control module 13 directs the action of the shunt circuit 14 in response to commands received via a network interface circuit (not shown) or the radio 12 from the CCS 15. The current measurement/shunt control module 13 is configured or programmed to respond to a signal to control the shunt circuit 14, e.g., to cycle on/off the application of a shunt to rails 11*a*, 11*b*, and to place a track circuit voltage across the two rails 11*a*, 11*b* for current measurement.

The shunt circuit 14 includes a switch which may be closed to provide a very low resistance electrical path between the parallel rails 11*a*, 11*b* for the application of the shunt at the location of the broken rail detector. That is, shunt circuit 14 enables the application or removal of a shunt across rails 11*a*, 11*b*. The current measurement/shunt control module 13 may be configured to place a track circuit voltage across the rails 11*a*, 11*b* and include a current sensing device, e.g., a Hall effect sensor, to measure current in the shunt circuit 14. The track circuit voltage may be provided by a DC voltage power supply and applied by a switch in the current measurement/shunt control module 13, which may be closed to place the DC voltage (or a coded DC (low frequency AC) voltage) across the parallel rails 11*a*, 11*b*. The analog measure of current by the sensor is converted to a digital signal by an analog-to-digital converter for use by the microcontroller. The microcontroller may have an on-board input for analog signals which are converted to digital signals.

The current measurement/shunt control module may be configured to record a measurement time for each current measurement. The current measurement/shunt control module 13 is configured to output a signal to the network interface circuit or the radio 12 to the CCS 15 including the current measurement and the time for the current measurement. Alternatively, the current measurement/shunt control module 13 may output a signal indicating a broken rail condition based on the measured current, and/or the CCS 15 may determine a time for the broken rail condition based on a time that the signal is received from the current measurement/shunt control module 13. Accordingly a broken rail condition, as well as a location of the broken rail condition on the track may be determined by the system. The location of the broken rail may be determined by the CCS 15 based on the time that the current measurement occurred or the time that the broken rail condition was detected and a known location of a train or trains on the track. For example, if a current measurement indicating a rail break is received with a particular measurement time, the CCS 15 may determine the location of the rail break based on a location of a train at the time of the current measurement.

Accordingly, BRD measurements may be sent to the CCS 15 for analysis according to a preferred and non-limiting embodiment, and the CCS 15 may compare and correlate the BRD measurements with the known locations of the trains on the track 11. According to another preferred and non-limiting embodiment, the BRDs may be configured to determine a step function drop in the measured current as indicating a broken rail condition, and the determined step function drop may trigger the BRD to send a signal indicating the broken rail condition to the CCS 15. The signal indicating the broken rail condition may be sent from the determining BRD to the CCS 15 on a faster interval than an interval for normal reporting of the measured current. Alternatively, the BRDs may receive information on the known locations of the trains on the track 11 from the CCS 15, or the CCS 15 may be incorporated in one or more of the BRDs, such that the BRD itself may determine the presence of a rail break condition and a location of the rail break on the track 11.

Still referring to FIG. 1, if Train A and Train B are traveling on the track 11, a dynamic track circuit is created upon the rails between Train A and Train B with each train applying a shunt to the track 11. The current measurement/shunt control module 13 of the first broken rail detector BRD1 may apply a constant voltage to the dynamic track circuit, and the current of the dynamic track circuit formed between Train A and Train B may be monitored by the current measurement/shunt control module 13 of the first broken rail detector BRD1. For a normal integral rail, and in one preferred and non-limiting embodiment, the current level for a given source voltage applied by the current measurement/shunt control module 13 is a function of the following: (1) rail resistance (typically 0.35 ohms per km); (2) ballast resistance (typically in a range of 2 to 10 ohms per km, and variable (e.g., by rain)); and (3) shunt resistance (typically close to zero, with a maximum of 0.5 ohms). Accordingly, a range of currents expected for a normal track without a broken rail is computed based on at least the above listed factors, e.g., a combination of series (track and shunt resistances) and parallel (ballast) resistance to determine a typical current for a given track voltage. A BRD may compare the range of currents computed for the normal track without a broken rail with the current measured by the BRD in a track circuit to determine if a rail break condition exists in the track circuit. For example, if the measured current is outside the range of currents computed for the normal track without a broken rail, a rail break condition may be determined to have occurred in the track circuit by the BRD. Alternatively, as described above in another preferred and non-limiting embodiment, a step function drop in the measured current may be determined by the BRD as indicating a broken rail condition, and the range of currents for the normal track need not be computed.

The track impedance measurement may be performed with a fixed voltage or a variable voltage. A range of voltages, which may relate to a specific application for optimizing the circuit for distance/ballast conditions, as well as considering different available power sources, may be used for measuring the track impedance. If a variable voltage is used to measure the track impedance, the microcontroller measures the voltage applied as part of the impedance measurement, combined with the measured current. A continuous measurement of impedance (voltage constantly applied to the circuit) may be performed, or intermittent measurements using short pulses, e.g., around 200 ms on-time duration) may be used. A timing between measurement pulses may be varied by the microcontroller and/or based upon CBTC knowledge of train locations and speeds. For example, if there are no approaching trains, the time between impedance measurements may be extended to save power. As a train approaches, the time checks may be reduced. If the train is over the BRD location, there is no need to make any measurements until the train is close to passing the BRD location, at which time, continuous or higher frequency checks may be performed to increase the precision of locating a rail break after the train clears the rail break location.

The current measurement/shunt control module 13 sends the measurements of the dynamic track circuit current and the corresponding measurement times or the detected broken rail conditions to the CCS 15 or another central processing system via the network interface circuit or the radio 12. The CCS 15, which already knows the location of the front end and the location of the back end of each train on track 11, receives the dynamic track circuit current measurements and times and processes the measurements and times. If the ballast and shunt resistances of the dynamic track circuit between Train A and Train B are relatively constant (at least over short periods of time), the CCS 15 can confidently determine a range of current readings that would be expected for the dynamic track circuit for a continuous non-broken rail. The CCS 15 determines a range of current readings that would be expected for the dynamic track circuit between Train A and Train B for a continuous non-broken rail, and compares the determined range to the dynamic track current measurements received from the current measurement/shunt control module 13.

For example, if a rail break occurs under Train A, when the back end of Train A passes the break point, a step function reduction in the dynamic track circuit current occurs. The current measurement/shunt control module 13 detects the step function reduction in the dynamic track circuit current and sends the corresponding measurement to the CCS 15 and the time that the measurement occurred. The CCS 15 correlates the measured drop in current to the known train location at the time of the measured drop to determine the location of the rail break on the track 11. For example, the location of the back end of Train A on track 11 at the time that the measured drop in the current occurs is determined as the location of the rail break on track 11. The CCS 15 communicates a rail break warning or a corresponding limit of authority and/or speed to a following train, e.g., Train B, and/or to other members of the rail system. The rail break warning may include the time and/or the location of the rail break on the track 11.

Alternatively, the CBTC office 15 may provide the current measurement/shunt control module 13 or another data processing system with the locations of the trains, such that the processing for determining if a broken rail exists, as well as for determining the location of the broken rail on the track 11, may be performed in the current measurement/shunt control module 13 or elsewhere in the system.

A limit in the ability to detect rail breaks exists based upon a distance of the rail break point from a location of the broken rail detector BRD and the distance of the following train. For example, a worst case scenario occurs if a rail break occurs just behind a next broken rail detector BRD location in a travel direction of Train A, and the following Train B is close to, but has not reached, the previous broken rail detector BRD in the same travel direction. In this case, the majority of dynamic track circuit current follows the Train B approaching the previous broken rail detector, with only a minimal change occurring on the long end of the circuit where the rail break occurs. Accordingly, there is need for a relationship between distances between broken rail detector BRD locations and planned train separation, in a similar manner as signal block designs for conventional track circuits. For example, if a system is designed to support following moves of 6 km, broken rail detector BRD locations may be planned to be about 4 km apart to enable a broken rail to be detectable at any location along the track.

FIG. 2 illustrates a track with a broken rail detection system according to another preferred and non-limiting embodiment. As shown in FIG. 2, Train A has already passed the first broken rail detector BRD1 and Train B has not yet passed the second broken rail detector BRD2 in the travel direction of the track 11. The broken rail detector BRD 1, under CCS 15 control, applies a constant track voltage to the track 11 and monitors/measures the current in the dynamic track circuit. The second broken rail detector BRD2, under CCS 15 control, applies a shunt to the track 11 to terminate an end of the dynamic track circuit. The dynamic track circuit is thus formed by the shunt from the last car in Train A, and the track shunt applied at the second broken rail detector BRD2. The first broken rail detector BRD1 measures the dynamic track circuit current to detect a drop if there is a rail break under Train A, as soon as the back end of Train A passes the rail break location.

A broken rail detection system according to preferred and non-limiting embodiments is directed to detecting breaks under trains immediately after the trains pass the break point. In an above preferred and non-limiting embodiment illustrated in FIG. 2, after Train B breaches the second broken rail detector BRD2 location, i.e., passes the second broken rail detector BRD2 in the travel direction of the track 11, the second broken rail detector BRD2 transitions from a shunt mode to a current detection mode, and the front end of Train B creates the track shunt needed to complete the dynamic track circuit with the back end of Train A for the current monitoring/measuring performed by the first broken rail detector BRD1. The first and second broken rail detectors BRD1 and BRD2 maintain their respective modes until the back end of Train A passes the next broken rail detector BRD monitoring location (or the back end of Train B passes the first broken rail detector BRD1) in the travel direction of the track 11.

The CCS 15 knows the location of the front end and the location of the back end of all of the trains on the track 11 substantially in real time and controls each broken rail detector BRD to operate in one of the following three BRD modes: (1) Off or power down mode: No trains in area; (2) Shunt mode: Apply a shunt across the rails 11*a*, 11*b*; (3) Current monitor mode: Apply a track circuit voltage and monitor current of the dynamic track circuit. The CCS 15 is configured to control the multiple broken rail detectors along the track 11 to transition between the three BRD modes depending upon corresponding train location situations as described above with respect to FIGS. 1 and 2.

A broken rail detector BRD in current mode reports current data measured in the dynamic track circuit and current measurement times to the CCS 15 so that the CCS 15 can determine rail fault conditions and associated locations. As previously noted, logic for determining rail fault conditions and associated locations may be distributed across the system to reduce the amount and time criticality of data reporting from the broken rail detectors BRDs to the CCS 15. For example, routine data reporting may be performed at longer time intervals, and a broken rail detector BRD may include logic to report on an exception basis when detecting a step function drop in current, as occurs when a monitored train passes a rail break location.

Figure 3:
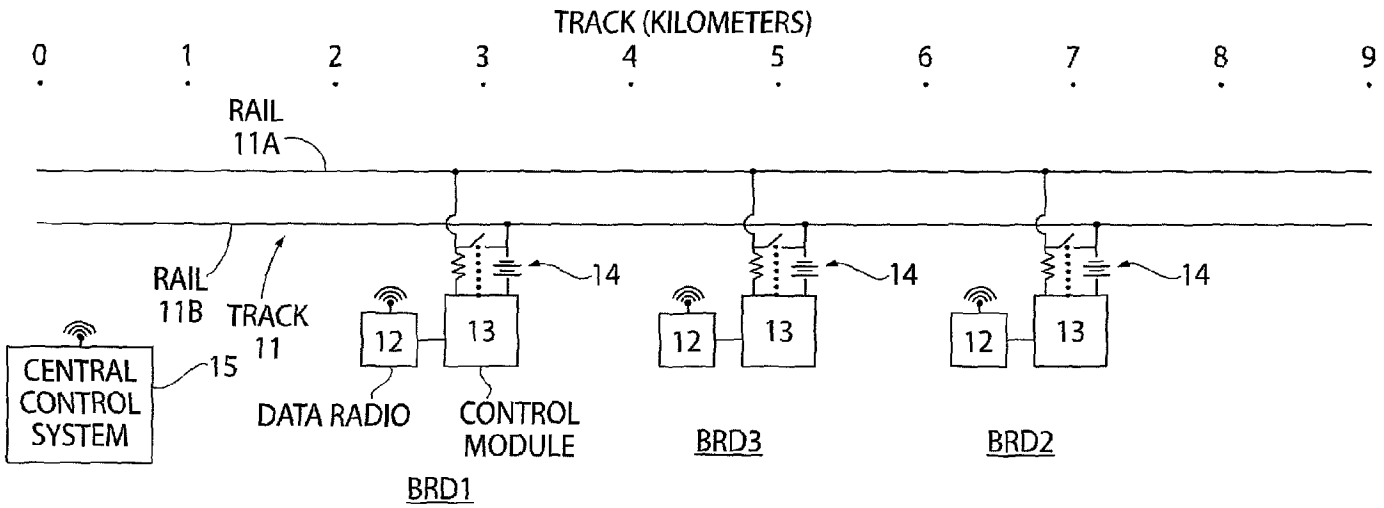
FIG. 3 is a schematic view of a further embodiment of a broken rail detection system according to the principles of the present invention.

FIG. 3 illustrates a track with a broken rail detection system according to still another preferred and non-limiting embodiment that enables rails to be checked for breaks if there are no trains in an area. For example, for three sequential BRD locations on track 11, a third, middle broken rail detector BRD3 may be placed in current detection mode, and first and second broken rail detectors BRD1 and BRD2 on respective sides of the middle broken rail detector BRD3 on the track 11 may be placed in shunt mode. The shunts on each side of the middle broken rail detector BRD3 thus form a track circuit, and the middle broken rail detector BRD3 applies a track voltage and measures a current through the track circuit formed by the outside broken rail detectors BRD1 and BRD2. The current measurements taken by the middle broken rail detector BRD will be within a defined level based upon the variation of ballast resistance. The middle broken rail detector BRD3 may send the current measurements to the CCS 15 for processing to determine if a rail break exists between the two outside BRDs or, alternatively, the middle broken rail detector BRD3 may perform the processing itself. A test using three sequential BRDs may be performed on an intermittent basis to verify rail integrity before trains start; however, such a test need not be performed on a continuous or high repetition rate basis, because rail breaks are known to occur predominantly under trains.

Dragging equipment detectors may be co-located at the same locations as the broken rail detectors BRDs to enable use of the same infrastructure and data communications link to the CCS 15.

A broken rail detection system according to preferred and non-limiting embodiments may be configured for application to block sections between interlockings on a track. Conventional track circuits may be applied as "over switch" (OS) locations, and may be tied to CBTC based switch control logic and protection.

Figure 4:
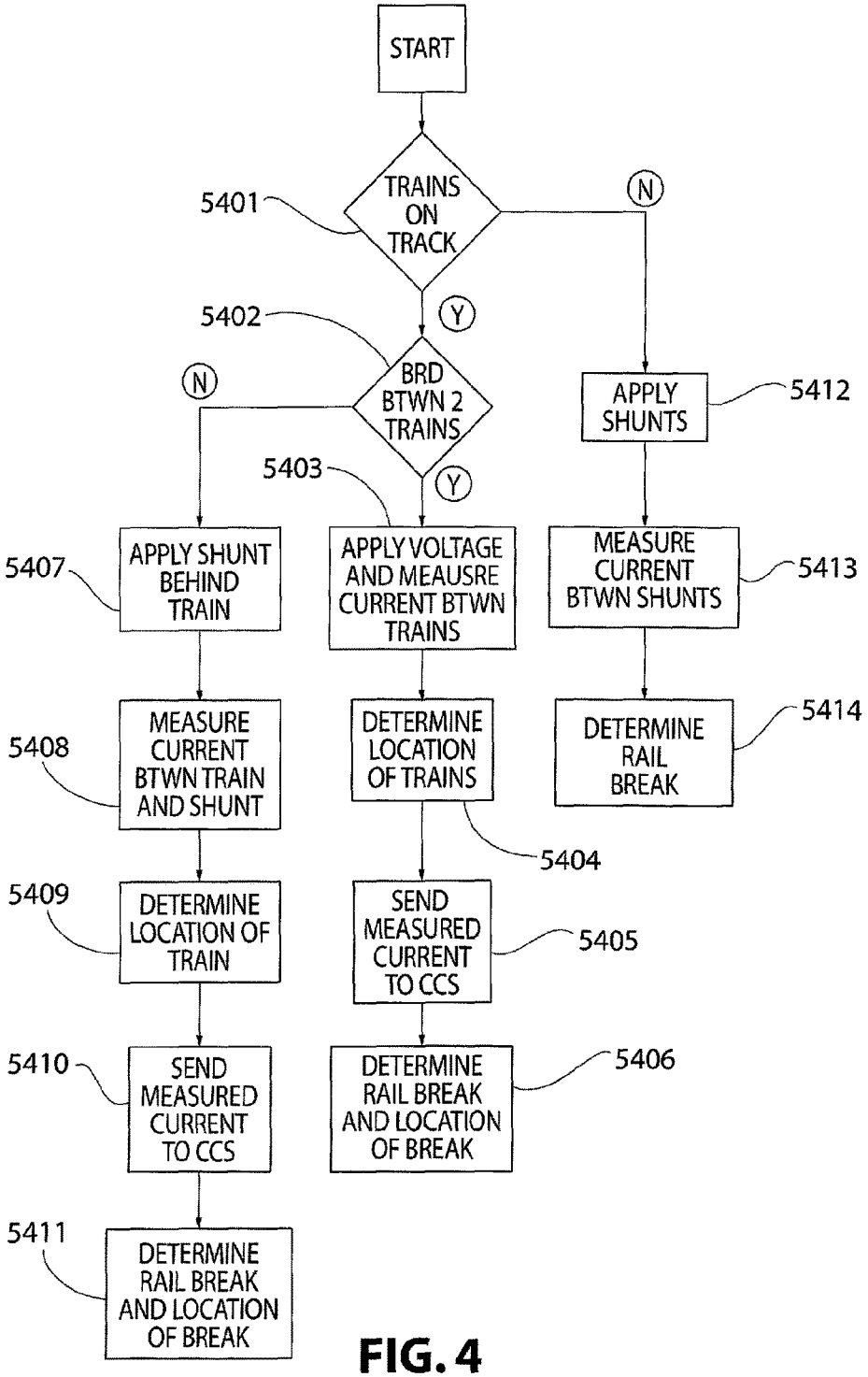
FIG. 4 is a flow chart showing methods for detecting a broken rail according to the principles of the present invention.

FIG. 4 is a flow chart showing methods for detecting a broken rail according to preferred and non-limiting embodiments. In step S401, the CCS 15 may initially determine if there are any trains on an area of the track 11. If there is one or more trains on the area of the track 11, processing proceeds to step S402, which determines if there is a single broken rail detector BRD located between two trains on the track 11. If it is determined at step S402 that a single broken rail detector exists between two trains, in step S403, the broken rail detector between the two trains (BRD1 in FIG. 1) applies a constant voltage to the dynamic track circuit formed between the two trains, and the current of the dynamic track circuit formed between the trains (Train A and Train B in FIG. 1) is monitored/measured by the current measurement/shunt control module 13 of the first broken rail detector BRD1. In step S404, the CCS 15 provides the location of the front end and the location of the back end of each train on track 11. The first broken rail detector BRD1 sends a signal based on the dynamic track circuit current measurements and/or measurement times to the CCS 15 in step S405. CCS 15 receives the signal and processes the measurements or notifications therein in combination with the known locations of the trains to determine if a rail break exists and a location of the rail break on the track 11 in step S406. The CCS 15 may report the rail break, the location of the rail break and the time of the rail break to any following trains or other entities in the rail system.

If, at step S402, it is determined that a single broken rail detector is not located between two trains, processing may proceed to step S407 so that a shunt is applied by a second (farther away) broken rail detector behind a train (BRD2 in FIG. 2 for Train A). The first (closer) broken rail detector behind the train (BRD1 in FIG. 2 for Train A) applies a constant track voltage to the track 11 and monitors/measures the current in a dynamic track circuit in step S408. For example, for Train A in FIG. 2, the first broken rail detector BRD1 may monitor/measure the current in a dynamic track circuit between the Train A and the shunt applied by the second broken rail detector BRD2. In step S409, the CCS 15 provides the location of the front end and the location of the back end of the Train A on the track 11. The first broken rail detector BRD1 sends a signal based on the dynamic track circuit current measurements to the CCS 15 in step S410. The CCS 15 processes the measurements and/or notifications in the signal in combination with the known location of the back end of Train A to determine if a rail break exists and a location of the rail break on the track 11 in step S411. The CCS 15 may report the rail break, the location of the rail break, and the time of the rail break to any following trains or other entities in the rail system.

If, however, the CCS 15 determines at step S401 that there are no trains in the area on the track 11, processing may proceed to step S412. In step S412, two broken rail detectors (BRD1 and BRD2 in FIG. 3) on respective sides of a middle broken rail detector (BRD3 in FIG. 3) in the area on the track 11 may apply shunts to the track 11. The middle BRD3 applies a voltage to the track circuit formed by the two outside broken rail detectors BRD1 and BRD2 and measures the current through the track circuit in step S413. In step S414, the middle BRD3 determines if a rail break exists between the two outside BRDs by sending a signal based on the current measurements to the CCS 15 for processing or, alternatively, the middle BRD may perform the processing itself.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A system for detecting broken rails in a track of parallel rails, the system comprising:

at least one first broken rail detection module configured to measure a current through the track; and a central control system configured to determine a location of at least one train on the track, wherein the at least one first broken rail detection module is configured to store a measurement time of a current measurement, and wherein the central control system is configured to determine if a broken rail exists on the track based at least partially on the stored measurement time of the current measurement.

2. The system of claim 1, wherein the central control system is configured to determine a location of the broken rail on the track based at least partially on a measurement time of the measured current and a location of the at least one train on the track at the measurement time.

3. The system of claim 1, wherein the central control system is configured to determine locations of at least a first train and a second train on the track, wherein the at least one first broken rail detection module is configured to measure a current through a dynamic track circuit formed in the track between the first train and the second train, and wherein the central control system is configured to determine if a broken rail exists on the track based at least partially on the measured current and the location of the first train and the second train.

4. The system of claim 1, further comprising:

at least one second broken rail detection module configured to apply a shunt to the track, wherein the at least one first broken rail detection module is configured to measure a current through a dynamic track circuit formed in the track between the at least one train and the shunt applied by the at least one second broken rail detection module.

5. A system for detecting broken rails in a track of parallel rails, the system comprising:

at least one first broken rail detection module configured to measure a current through the track and store a measurement time for measuring the current through the track; and a central control system configured to determine a location of at least one train on the track, wherein the central control system is configured to send the at least one first broken rail detection module the location of the at least one train on the track, and wherein the at least one first broken rail detection module is configured to determine if a broken rail exists on the track based at least partially on the stored measurement time.

6. A system for detecting broken rails in a track of parallel rails, the system comprising:

at least one first broken rail detection module configured to measure a current through the track and store a measurement time for one or more measures of the current; and a central control system configured to determine a location of at least one train on the track, wherein the at least one first broken rail detection module is configured to send the central control system a signal indicating a broken rail condition on the track; and wherein the central control system is configured to determine a location of the broken rail on the track based at least partially on the stored measurement time.

7. A system for detecting broken rails in a track of parallel rails, the system comprising:

a first broken rail detection module configured to apply a first shunt to the track at a first location;

a second broken rail detection module configured to apply a second shunt to the track at a second location;

a third broken rail detection module configured to measure a current in a track circuit formed between the first shunt and the second shunt and store one or more measurement times for one or more respective measures of a current in the track; and a central control system configured to determine if a broken rail exists on the track between the first broken rail detection module and the second broken rail detection module based at least partially on the measured current in the track circuit.

8. A method for detecting broken rails in a track of parallel rails, the method comprising:

measuring, by at least one first broken rail detection module, a current through the track;

storing, by at least one first broken rail detection module, one or more measurement times for measuring one or more currents through the track;

determining, by a central control system, a location of at least one train on the track based on the stored one or more measurement times;

communicating, by the at least one first broken rail detection module, a signal based on the measured current to the central control system; and determining, by the central control system, if a broken rail exists on the track based at least partially on the measured current and the location of the at least one train on the track.

9. The method of claim 8, wherein the determining, by the central control system, if a broken rail exists on the track comprises determining a location of the broken rail on the track based on a measurement time of the measured current and a location of the at least one train on the track at the measurement time.

10. The method of claim 8, further comprising:

determining, by the central control system, locations of at least a first train and a second train on the track, wherein the current measured through the track is a current through a dynamic track circuit formed in the track between the first train and the second train, and wherein the central control system determines if a broken rail exists in the track based at least partially on the signal based on the measured current and the location of the first train and the second train.

11. The method of claim 8, further comprising:

applying, by at least one second broken rail detection module, a shunt to the track, wherein the current measured through the track is a current through a dynamic track circuit formed in the track between the at least one train and the shunt applied by the at least one second broken rail detection module.

12. A method for detecting broken rails in a track of parallel rails, the method comprising:

measuring, by at least one first broken rail detection module, a current through the track and a measurement time for measuring the current through the track;

determining, by a central control system, a location of at least one train on the track;

communicating, by the central control system, the location of the at least one train on the track to the at least one first broken rail detection module; and determining, by the at least one first broken rail detection module, a trains proximity to a broken rail on the track based at least partially on the measured current, the measurement time, and the location of the at least one train on the track.

13. A method for detecting broken rails in a track of parallel rails, the method comprising:

measuring, by at least one first broken rail detection module, a current through the track;

determining, by a central control system, a location of at least one train on the track;

communicating, by the at least one first broken rail detection module, a signal indicating a broken rail condition on the track to the central control system; and determining, by the central control system, a location of the broken rail on the track based at least partially on the location of the at least one train on the track and a time associated with measuring the current through the track.

14. A method for detecting broken rails in a track of parallel rails, the method comprising:

applying, by a first broken rail detection module, a first shunt to the track at a first location;

applying, by a second broken rail detection module, a second shunt to the track at a second location;

measuring, by a third broken rail detection module, a current in a track circuit formed between the first shunt and the second shunt; and determining, by a central control system, if a broken rail exists on the track between the first broken rail detection module and the second broken rail detection module based at least partially on the measured current in the track circuit and a time associated with measuring the current in the track circuit.

15. A method for detecting broken rails in a track of parallel rails, the method comprising:

receiving, by a central control system, a signal at least partially based on a current measured through the track and a time associated with measuring the current in the track circuit;

determining, by the central control system, a location of at least one train on the track based on the time associated with measuring the current in the track circuit;

processing, by the central control system, the signal and the location of the at least one train to determine if a broken rail exists on the track.

16. The method of claim 15, further comprising:

determining, by the central control system, a location of the broken rail on the track based at least partially on a measurement time of the measured current and a location of the at least one train on the track at the measurement time.

17. The method of claim 15, further comprising:

determining, by the central control system, locations of at least a first train and a second train on the track, wherein the measured current comprises a current through a dynamic track circuit formed in the track between the first train and the second train; and determining, by the central control system, if a broken rail exists on the track based at least partially on the measured current and the location of the first train and the second train.

18. A central control system for detecting broken rails in a track of parallel rails, the system comprising:

a receiving unit configured to receive a signal at least partially based on a current measured through the track from at least one broken rail detection module; and a processor configured to determine a location of at least one train on the track based on a time associated with measuring the current through the track, wherein the processor is configured to determine if a broken rail exists on the track at least partially based on the signal and the location of the at least one train on the track.

19. The system of claim 18, wherein the processor is configured to determine a location of the broken rail on the track based at least partially on a measurement time of the measured current and a location of the at least one train on the track at the measurement time.

20. The system of claim 18, wherein the processor is configured to determine locations of at least a first train and a second train on the track, wherein measured current comprises a current through a dynamic track circuit formed in the track between the first train and the second train, and wherein the processor is configured to determine if a broken rail exists on the track based at least partially on the measured current and the location of the first train and the second train.

* * * * *